United States Patent [19]

Bassi

[11] Patent Number: 4,949,229

[45] Date of Patent: Aug. 14, 1990

[54] LIGHT-BULB HOLDING DEVICE FOR HOUSEHOLD APPLIANCES

[75] Inventor: Alberto Bassi, Turin, Italy

[73] Assignee: ITW Fastex Italia, S.p.A., Turin, Italy

[21] Appl. No.: 360,572

[22] Filed: Jun. 2, 1989

[30] Foreign Application Priority Data

Jun. 3, 1988 [IT] Italy ..... 53198/88[U]

[51] Int. Cl.[5] ..... F21V 33/00

[52] U.S. Cl. ..... 362/92; 362/94; 362/155; 362/295; 62/264; 200/310

[58] Field of Search ..... 362/92, 94, 154, 155, 362/368, 23, 295, 802; 337/377; 62/126, 264; 200/310; 439/620, 645

[56] References Cited

U.S. PATENT DOCUMENTS

| | | | |
|---|---|---|---|
| 2,104,164 | 1/1938 | Osborne | 362/94 |
| 2,156,462 | 5/1939 | Schulte | 362/94 |
| 2,234,474 | 3/1941 | Higham et al. | 62/264 |
| 2,245,837 | 6/1941 | Stoddard et al. | 62/264 |
| 2,385,525 | 9/1945 | McCloy | 62/264 |
| 2,618,126 | 11/1952 | Edwards | 62/264 |
| 3,009,051 | 11/1961 | Bittrolff | 362/23 |
| 3,597,563 | 8/1971 | Schmiedel | 200/310 |

FOREIGN PATENT DOCUMENTS

| | | | |
|---|---|---|---|
| 0134264 | 11/1978 | Japan | 62/264 |

*Primary Examiner*—Ira S. Lazarus
*Assistant Examiner*—D. M. Cox
*Attorney, Agent, or Firm*—Schwartz & Weinrieb

[57] ABSTRACT

A light-bulb holding device for household appliances in general, and for refrigerators or freezers in particular, comprises a board structure equipped, at a first end, with a sleeve for accommodating a stem portion of a light bulb and, at a second end, opposite to the first end, with a longitudinal slot within which is mounted, in a freely slidable mode, a switch stem which interacts so as to strike, under the action of a biasing spring, with a pair of electrical contacts defined means of respective metal tabs carried laterally by a first lateral surface of the aforenoted board structure and projecting from it in a perpendicular direction. The stem is equipped with a head which projects from the slot and the board structure is equipped, on the first surface and on a second lateral surface opposite to the first surface, with opposed attaching means for, respectively, mounting and electrically connecting a thermostat and a multiple power supply connector.

13 Claims, 2 Drawing Sheets

LIGHT-BULB HOLDING DEVICE FOR HOUSEHOLD APPLIANCES

FIELD OF THE INVENTION

The present invention relates to a light-bulb holding device for household appliances, and in particular, an internal illuminating device for refrigerators and/or freezers.

BACKGROUND OF THE INVENTION

The internal illumination of refrigerators and freezers is known to be provided by means of a light bulb mounted within a light-bulb holder fixed inside the household appliance and activated by means of a lever switch controlled, in turn, by means of the opening/-closing of the refrigerator or freezer door. This switch, which is connected, on one side, to the household appliance electrical power cable and, on the other side, to the light-bulb holder, is normally maintained in its OPEN position by means of the bulk of the door, in the closed position, against which a switch lever is biased by means of a spring. When the door is opened by the user, means of a spring is no longer restrained by means of the bulk of the door and therefore biases the switch to its closed position, thus illuminating the light bulb. When the door is being closed, the lever is moved against the biasing force of the spring as soon as it is contacted by means of the door, thus extinguishing the light.

Another electrical device present within a refrigerator and that must be supplied by the aforenoted electrical power and installed near the light-bulb holder, so that the user is able to read it, is the thermostat for regulating the temperature within the refrigerator, which in current household appliances is supported and powered separately from the lamp-holder. It is obvious that it requires an extremely complex design to install and power the light-bulb holder separately from the other electrical accessories, such as the thermostat and the switch, present within the household appliance. To these circumstances must be added the fact that the various thermostat models currently used require widely different power connections, thus making it necessary to provide assembly bases for the different thermostats, according to their type. This drawback becomes even more difficult to resolve if the designer wished to use the light-bulb holder as a base for the thermostat, as it would be necessary to provide numerous design variants of the same model in accordance with the type of thermostat used, with consequent high manufacturing costs due to the lack of large-scale economy, assembly and storage complications.

OBJECT OF THE INVENTION

It is the object of the present invention to provide a light-bulb holding device, which is extremely easy to produce and assemble, which enables all of the necessary electrical connections to be made in a quick and simple manner within a household appliance and the supporting structure, and which may be constructed using the same molds.

SUMMARY OF THE INVENTION

According to the present invention, there is provided a light-bulb holding device for household appliances and, in particular for refrigerators and freezers, characterized by the fact that it comprises in combination: a board-shaped structure with first and second opposite ends and delimited laterally by means of first and second respective oppositely disposed surfaces; a support and power supply sleeve for a light bulb fixedly mounted upon the board structure at one end of the structure and adapted for accommodating a stem portion of the light bulb; a switch stem slidably mounted within a slot machined within one end of the and fitted with a head projecting axially from the end, out of the slot, the slot accommodating at the other end a counteracting spring for the switch stem which is adapted to maintain a transverse contact held by means of the switch stem against a pair of electrical contacts defined by means of respective metal tabs projecting in a perpendicular direction from the first surface; and oppositely disposed attaching means held by means of the surfaces of the board structure for receiving respectively a thermostat and a multiple electrical power connector for the thermostat and the light bulb.

BRIEF DESCRIPTION OF THE DRAWINGS

The invention will be described by way of example, with reference to the accompanying drawings, in which.

DETAILED DESCRIPTION OF THE INVENTION

Figure 1:
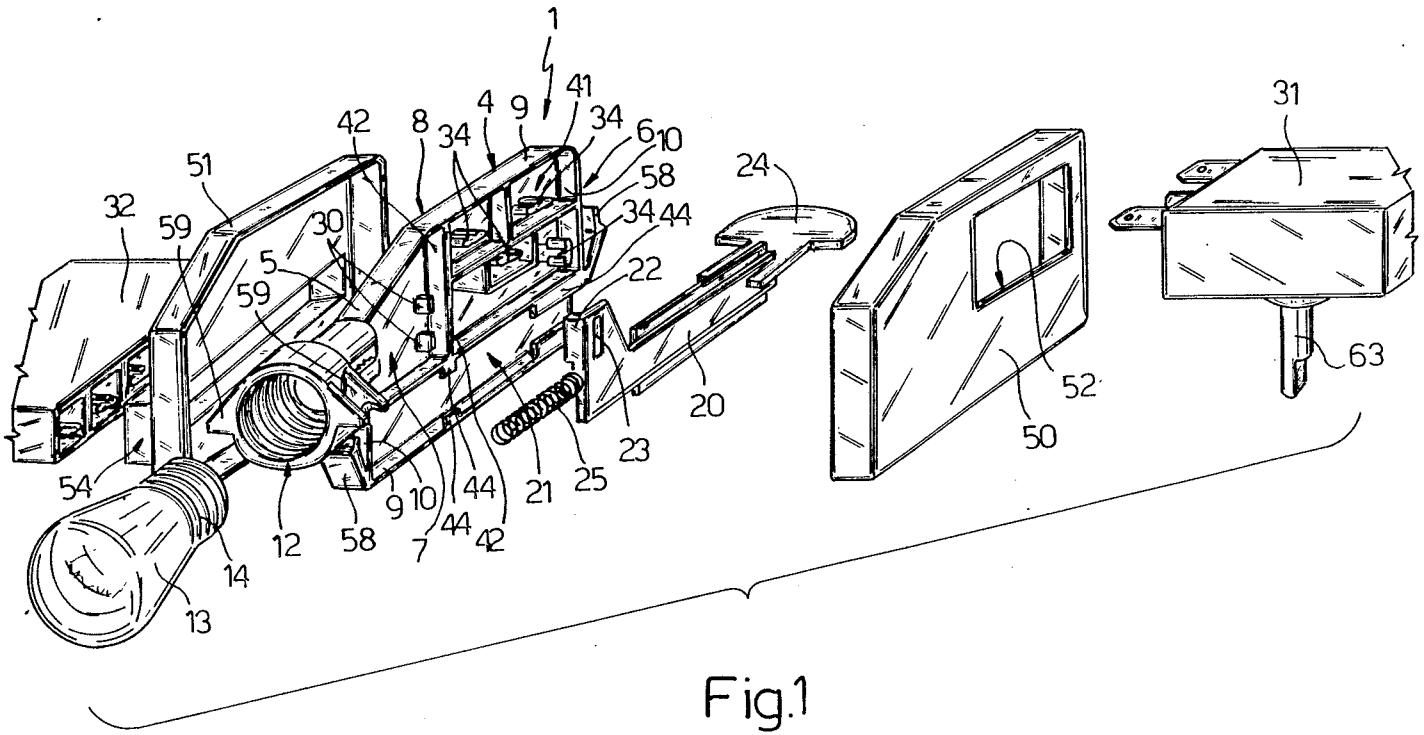
FIG. 1 is an exploded perspective rear three-quarter view of the light-bulb holding device constructed in accordance with the invention.
Figure 2:
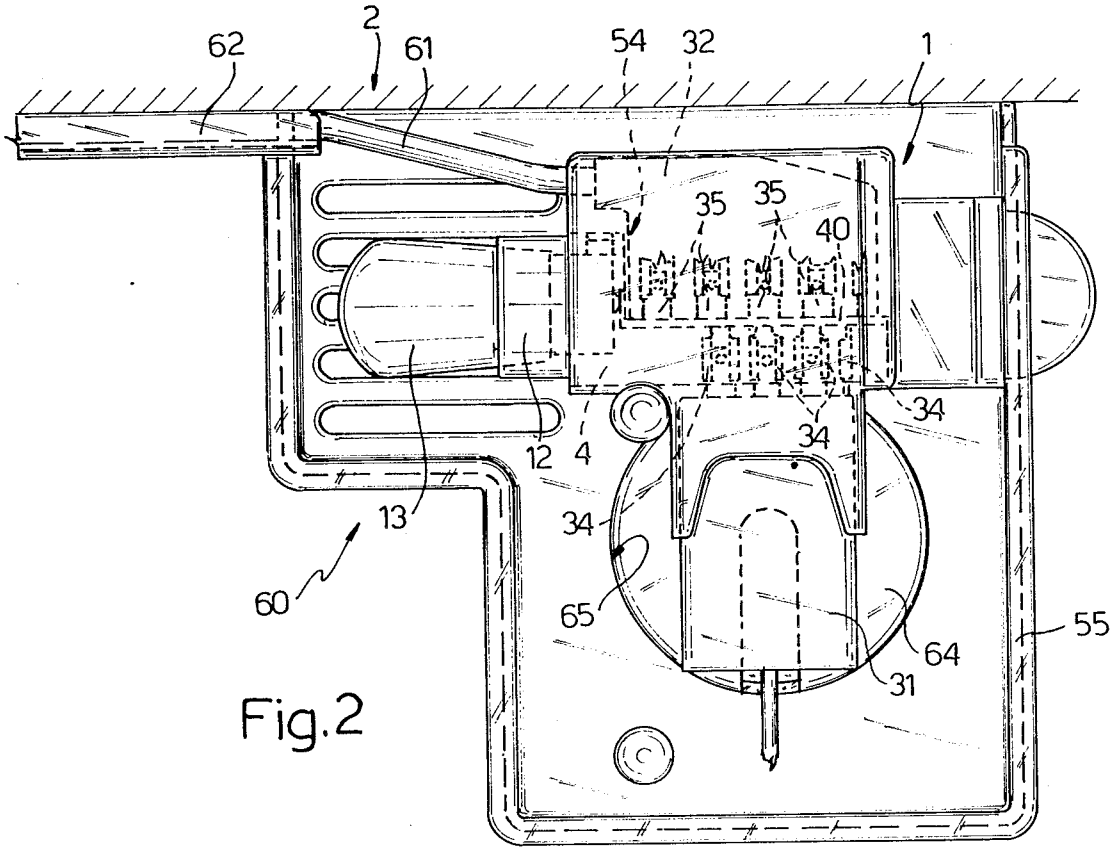
FIG. 2 is, on an enlarged scale, a plan view from above of the light-bulb holder of FIG. 1 integrated into a complex illuminating and control device for a household appliance equipped with the light-bulb holder shown in FIG. 1.

With reference now being made to FIGS. 1 and 2, the numeral 1 indicates a light bulb holding device, hereinafter referred to more simply as light-bulb holder 1, for all known types of household appliances, only a part of an inner panel 2 of which is illustrated, for the sake of simplicity, as representing, for example, a refrigerator or freezer. Light-bulb holder 1 comprises a bearing structural element defined, in accordance with the invention, by means of an elongated structure 4 having the form of a flat board and designed substantially for edgewise use, and which presents first and second oppositely disposed ends, respectively indicated by 5 and 6, and is further delimited laterally by means of a pair of oppositely disposed substantially flat surfaces 7 and 8 and, peripherally, by means of respective perimetral raised edges, that is, longitudinal edges 9 and transverse edges 10, which define a cup-like or recessed form or configuration for structure 4 upon the surface 7 side thereof. Light bulb holder 1 also comprises a sleeve 12 of a known type, which may, for example, be threaded, and which is adapted to support and supply electrical power to a known light bult 13. In accordance with the invention, sleeve 12 is incorporated within, or is integrally formed as a single piece with board structure 4 at the rear end 5 (as seen from the position of use) of the structure, and is adapted to accommodate a stem portion 14 of light bulb 13. Structure 4 and sleeve 12 should preferably be obtained through means of the molding of a synthetic plastic resin and the electrical energy is supplied to light bulb 13 through means of known respective contacts not illustrated here for the sake of simplicity, which are fixed to the inside of sleeve 12 in a known manner. Light bulb holder 1 also comprises a switch stem 20, preferably obtained by molding a synthetic plastic resin, which is accommodated so as to freely slide axially within a longitudinal slot 21 machined, in accordance with the invention, directly into board structure 4 at the front end 6 thereof, immediately underneath the sleeve 12 and extending from end 6 to the opposite end 5, that is along the entire length of board structure 4. Stem 20 includes a substantially L-shaped rear end 22 disposed towards end 5 and fixedly mounting a known transversely oriented laminated contact 23, illustrated only in part for the sake of simplicity, and a front head 24, disposed opposite to end 22 and having the form of a semicircular board disposed orthogonally with respect to the longitudinal plane of stem 20 and perpendicularly with respect to surface 7. This head 24 projects axially out from end 6 of board structure 4, and out of slot 21, which is open at this end due to a break in respective edge 10. Slot 21 accommodates, at the end 5 side thereof, a counteracting spring 25 for switch stem 20, the spring 25 of which, when installed, is inserted between the fixed shoulder defined by means of the corresponding edge 10 of end 5 and end 22 of stem 20. Spring 25 is adapted to maintain the respective transverse contact 23 and relative end 22 of stem 20 biased against a pair of electrical contacts also acting as a mechanical shoulder means for surface 7 and defined by means of respective metal tabs 30 projecting in a perpendicular direction from surface 7.

Finally, light-bulb holder 1 comprises, in accordance with the invention oppositely disposed attaching means mounted upon surfaces 7 and 8 of board structure 4 so as to receive, respectively, a thermostat 31 and a multiple electrical power connector 32 for providing electrical power to both thermostat 31 and light bulb 13, both of which are of a known type. These oppositely disposed attaching means comprise a plurality of engaging male and female electrical connectors 35 and 34, respectively, of a known type, such as, for example, Faston, connected electrically in a known manner, and machined so as to project in a perpendicular direction with respect to surfaces 7 and 8 of board structure 4. For example, the various connectors 34 and 35 and contacts 30 may be connected in any desired manner by means of an electrical circuit not illustrated, which is printed or produced upon one of the surfaces of structure 4, which, to the contrary, is fabricated from an insulating material; or else, according to a preferred embodiment as illustrated, the electrical connection of contacts 30 and connectors 34 and 35, and their securing means with respect to structure 4, are fabricated in a known manner by obtaining the components through means of semi-blanking or stamping and right-angle bending operations of a single conducting metal sheet 40 (FIG. 2), illustrated only schematically by means of a dotted line, which is installed within structure 4 through means of suitable forming operations performed in connection with the structure and, then subdivided into the various independent circuits as necessary by respectively punch blanking some of its parts, the same being maintained accessible from a position outside of the structure 4 through means of suitable holes, not illustrated, formed within structure 4. In the example shown, slot 21 is defined by means of a concavity (indicated by the same numeral) machined into surface 7 together with a second concavity 41, for housing engaging connectors 34 for thermostat 31, concavities 21 and 41 being delimited by means of perimetral edges 9 and 10 and by respective transverse stiffening ribs 42 incorporated within board structure 4 and projecting in a perpendicular direction with respect to surface 7.

A respective lower perimetral edge 9 and a respective rib 42 disposed parallel and adjacent to it, which delimit the concavity or slot 21 in a longitudinal direction, are equipped with transversely projecting shoulders 44, disposed parallel to surface 7 and machined along edges 9 and 10 and ribs 42, which are substantially the same thickness, these shoulders or projections 44 being adapted to interact with switch stem 20 so as to maintain the stem laterally within slot 21, so that the traditional switch lever structure is, in accordance with the invention, completely incorporated within, and fixed to, light bulb holder 1 and therefore an integral part thereof.

As an option, light bulb holder 1 also comprises a pair of covers 50 and 51 each of which has the form of a cup. Cover 50 may be snap-engaged, in a known manner, onto board structure 4 so as to cover surface 7 and slot 21 with the switch stem 20 freely mounted so as to slide within it, and is equipped, at a level corresponding with concavity 41, with a passing window 52 which is adapted to receive thermostat 31 for electrical connection to connectors 34 disposed, within concavity 41. Cover 51 may also, be snap-engaged, in a known manner, upon structure 4 so as to cover surface 8 and is equipped with a passing sleeve-shaped enclosure 54, which accommodates power supply connector 32, and which is formed in a longitudinal direction at a level which is similar to corresponding engaging connectors 35 for the connector 32. As is seen from the drawings, the connectors 35 are all arranged side by side in a straight line.

Board structure 4 also comprises snap-securing means for securing the device 1 to a suitable element of the aforenoted household appliance not illustrated, such as, for example, directly to panel 2 or to a box or ceiling lamp 55, which is preferably made from a transparent plastic material, and which, is in turn fixed in a known manner to panel 2. These securing means are more particularly defined by means of respective flexible tabs 58 which are toothed and V-shaped in configuration and which are machined so as to project axially from board structure 4 at the end pieces 5 and 6 thereof. Sleeve 12 is also equipped on the sides of both lateral surfaces 7 and 8, with respective projecting brackets 59 which are adapted to receive screws for retaining the aforenoted element of the household appliance, as is known and not illustrated for the sake of simplicity.

In accordance with the invention, light-bulb holder 1, with or without covers 50 and 51, forms an integrated illuminating and control device 60 for a refrigerator or freezer, illustrated in FIG. 2, comprising light-bulb holder 1, a light bulb 13 supported by means of sleeve 12, thermostat 31, mounted so as to project transversely from structure 4 from surface 7, power supply connector 32, mounted so as to project transversely from structure 4 from surface 8, and box 55, inside of which is snap-engaged light-bulb holder 1, together with thermostat 31, light bulb 13 and power supply connector 32.

Connector 32 is connected to an electrical cable 61 accommodated inside a groove 62 which passes through box 55 and is directly supported upon panel 2. Thermostat 31, which is equipped (FIG. 1) with a rotary drive shaft 63, the rotation of which enables the desired temperature to be maintained, is mounted in a known manner not illustrated for the sake of simplicity, by means of shaft 63, against a knob, desk, or plate 64, of which only the rear part is visible, so as to be supported loosely within box 55 through means of a circular slot 65.

From the description set forth above, the advantages of the invention are clear; the light-bulb holder described above constitutes a modular unit which is easy and economical to produce, is very compact and occupies little space, in a single assembling operation provides all the cabling required in order to supply both the illuminating light bulb and the thermostat, is supported directly by means of the light-bulb holder, instead of having to be installed separately upon the household appliance, and furthermore, the light-bulb holder, in accordance with the invention, also incorporates within a single unit the light bulb power on switch. Finally, as a result of the structure set forth above, structure 4 of light-bulb holder 1 in accordance with the invention may support and electrically connect any model of thermostat to a standard connector, without any need for modifications to its structure. It fact, concavity 41 is sufficiently wide to accommodate within it various configurations of connectors 34. It is therefore possible to produce light-bulb holders 1 of different types, each one adapted to a particular type of thermostat, simply by modifying the bending of metal sheet 40, but using the same mold so as to form structure 4, or else to produce universal light-bulb holders 1, simply by machining within concavity 41 as many connectors 34 as there are possible positions of the corresponding snap-engaging connectors of the thermostats to be installed. In this way, each type of connector will occupy only those connectors 34 adapted to them, leaving the others free and these, due to their position within concavity 41, do not create problems of space, or electrical dispersion, as they are associated with the ground of thermostat 31.

In conclusion, it is clear that the description set forth above may be varied or modified without exceeding the scope of the invention. For example, board structure 4, instead of being flat, as in the example illustrated, may have a curved or inclined outline, so as to be, for example L or C-shaped, out of the plane upon which it lies so as to form a complex three-dimensional structure and with metal sheet 40 enclosed within it. In addition, the opposed attaching means may be obtained by bending, out of the plane upon which structure 4 lies, some parts of metal sheet 40, which, within this case, are not enclosed in structure 4 and are shaped so as to ensure the necessary structural rigidity. In this manner, connector 32 and thermostat 31 may be installed upon structure 4, in a parallel rather than perpendicular direction, as in the example illustrated.

I claim:

1. A light-bulb holding device for household appliances, such as, for example, refrigerators and freezers, characterized in that it comprises in combination:

a substantially planar board-shaped structure having first and second opposite ends and first and second substantially planar surfaces disposed upon opposite lateral sides thereof;

a support and power supply sleeve for a light bulb fixedly mounted upon said board structure at one of said ends of said board structure and adapted for accommodating a stem of said light bulb;

switch means movably mounted upon said board structure in a first direction under the influence of a closure of said household appliance so as to be maintained in a normally OPEN position when said closure is disposed in a CLOSED state whereby electrical power is not provided to said light bulb;

a counteracting spring mounted upon said board structure and engaged with said movable switch means for maintaining said switch means in a CLOSED position when said closure is disposed in an OPEN state so as to provide electrical power to said light bulb;

means mounted upon one of said first and second planar surfaces of said board structure for supporting a thermostat; and means mounted upon a second one of said first and second planar surfaces of said board structure for supporting a multiple electrical power connector for providing electrical power to said thermostat and said light bulb.

2. A light bulb holder as set forth in claim 1, further comprising:

slot means defined within one of said first and second planar surfaces of said board structure; and said switch means is movably slidable within said slot means.

3. A light-bulb holder as set forth in claim 1, wherein:

said board structure and said light bulb sleeve comprise an integral molding fabricated from a thermoplastic resin.

4. A light-bulb holder as set forth in claim 1, further comprising:

first electrical contact means fixedly mounted upon said board structure; and second electrical contact means fixedly mounted upon said movably mounted switch means for engaging and disengaging said first electrical contact means of said board structure when said switch means is disposed at said CLOSED and OPEN positions, respectively.

5. A light-bulb holder as set forth in claim 2, wherein:

said switch means includes a head portion which projects out of said slot means for engagement with said appliance closure such that said switch means is moved toward said OPEN position by said appliance closure.

6. A light-bulb holder as set forth in claim 1, further comprising:

a box-type housing for accommodating said board structure, said light-bulb sleeve, said light bulb, said thermostat, and said power connector;

channel means structurally connected to said box-type housing; and electrical cable means disposed within said channel means and electrically connected to said power connector for providing electrical power to said power connector.

7. A light-bulb holder as claimed in claim 2, characterized in that said support and power supply sleeve for the light bulb is incorporated in a single piece with said board structure at said first end of said structure, said slot being machined at said second end of said board structure and containing said spring on the side of said first end.

8. A light-bulb holder as claimed in claim 2, characterized in that:

said means for supporting said thermostat and said means for supporting said power connector comprises oppositely extending attaching means comprising a plurality of engaging contacts, electrically connected to each other, mounted upon a metal sheet disposed within said board structure.

9. A light-bulb holder as claimed in claim 8, characterized in that said engaging contacts are machined to project in a perpendicular direction from said surfaces of the board structure.

10. A light-bulb holder as claimed in claim 8, characterized in that said slot means for the switch means is defined by a first concavity machined into said first surface together with a second concavity, containing said engaging contacts for the thermostat.

11. A light-bulb holder as claimed in claim 10, characterized in that said concavities on the first surface are delimited by respective perimetral edges and a respective ribbing delimiting the first concavity being equipped with transverse projecting shoulders, set parallel to the first surface, adapted to interact with the switch means for holding it laterally in its slot.

12. A light-bulb holder as claimed in claim 10, characterized in that it comprises a pair of cup-shaped covers, a first one of which may be snap-engaged on the board structure to cover said first surface and said slot and is equipped, in alignment with the second concavity, with a passing window; and a second one of which may be snap-engaged on the board structure to cover said second surface and is equipped with a passing slot for accomodating said power supply connector machined in a longitudinal direction on a level with said engaging contacts for said connector, said engaging contacts all being set side by side in a straight line.

13. A light-bulb holder as claimed in claim 1, characterized in that said board structure comprises snap-securing means for engaging an element of said household appliance defined by respective flexbile tabs machined to project axially from the board structure on a level with said end pieces of said structure.

* * * * *